US005823573A

United States Patent [19]

Chang

[11] Patent Number: 5,823,573

[45] Date of Patent: Oct. 20, 1998

[54] LOOSE-LEAF ALBUM FOR BOTH PHOTOGRAPHS AND FILM STORAGE

[76] Inventor: Jih-Cheng Chang, 3Fl., No.4, Lane 244, Hsing Lung Rd, Sec 2, Chin Mei 11714, Taipei, Taiwan

[21] Appl. No.: 650,366

[22] Filed: May 20, 1996

[51] Int. Cl.[6] ..... B42F 3/02

[52] U.S. Cl. ..... 281/38; 281/22; 402/79

[58] Field of Search ..... 281/38, 22; 402/79; 40/771, 772, 775, 776, 777

[56] References Cited

U.S. PATENT DOCUMENTS

| | | | |
|---|---|---|---|
| 3,651,591 | 3/1972 | Woodyard | 40/776 X |
| 4,356,649 | 11/1982 | Diamond et al. | 402/79 X |
| 4,447,973 | 5/1984 | Wihlke | 402/79 X |
| 4,704,042 | 11/1987 | Eisen et al. | 402/79 |
| 4,824,273 | 4/1989 | Silva et al. | 281/38 X |
| 4,965,948 | 10/1990 | Ruebens | 402/79 X |
| 4,972,952 | 11/1990 | Reiseneder | 281/38 X |
| 5,031,773 | 7/1991 | Manico et al. | 206/455 |
| 5,431,449 | 7/1995 | Arimoto et al. | 281/31 |
| 5,466,008 | 11/1995 | Ozeki | 402/79 X |
| 5,480,192 | 1/1996 | Angerbauer et al. | 281/31 |
| 5,501,540 | 3/1996 | Ho | 402/79 X |

*Primary Examiner*—Frances Han

[57] ABSTRACT

The present invention is a new design for loose-leaf pages which can store for easy retrieval both photographs and corresponding films on the same page so that we can quickly get the right film for a particular photograph. The main structure of the present invention includes three sections of pockets for storing photographs and their corresponding film. The loose-leaf page includes a first section with six pockets that can store six photographs arranged in two columns and three rows on each page. The second section of the page has pockets with an open edge in the center for storing either three, four, five or a maximum of up to six consecutive films. The third section of the page has a pocket for holding a single film or two consecutive films.

4 Claims, 7 Drawing Sheets

LOOSE-LEAF ALBUM FOR BOTH PHOTOGRAPHS AND FILM STORAGE

BACKGROUND OF THE INVENTION

The present invention is a new design for a loose-leaf page to store photographs and their corresponding film.

Obviously, we all have had the same experience when we want to duplicate a particular old photograph. That is, we need to look for the possible film from a mess of film sets. Then we must check and carefully compare the film, one by one with the photograph to find the right film.

It is because we always don't have a suitable loose-leaf page to store photographs and their corresponding film on the same page.

Therefore, a proper loose-leaf page that can store photographs and their corresponding film independently on the same page for easy retrieval is the basic idea of the present invention.

BRIEF DESCRIPTION OF THE PRIOR ART

U.S. Pat. Nos. 4,972,952 4,704,042 and 5,480,192 show the loose-leaf storage page with packets, but none of them suggest a special film storage pocket, which can store for easy retrieval either a single or multiple (up to six) film.

Therefore, the present invention provides a new storage structure and a new use of a loose-leaf page.

SUMMARY OF THE INVENTION

The primary objective of the present invention is to provide a loose-leaf page that can store both photographs and their corresponding film so that we can store for easy retrieval the right film whenever needed.

BRIEF DESCRIPTION OF THE DRAWINGS

The invention will be more readily understood with reference to the accompanying, wherein.

1–6 pockets for photographs

7 long pocket for a three, four, five, or a maximum of up to six film set

8 open edge at the center of the long pocket

9 short pocket for a single film

10 edge for apertures

11 symmetrical apertures

DETAILED DESCRIPTION OF THE INVENTION

Figure 1:
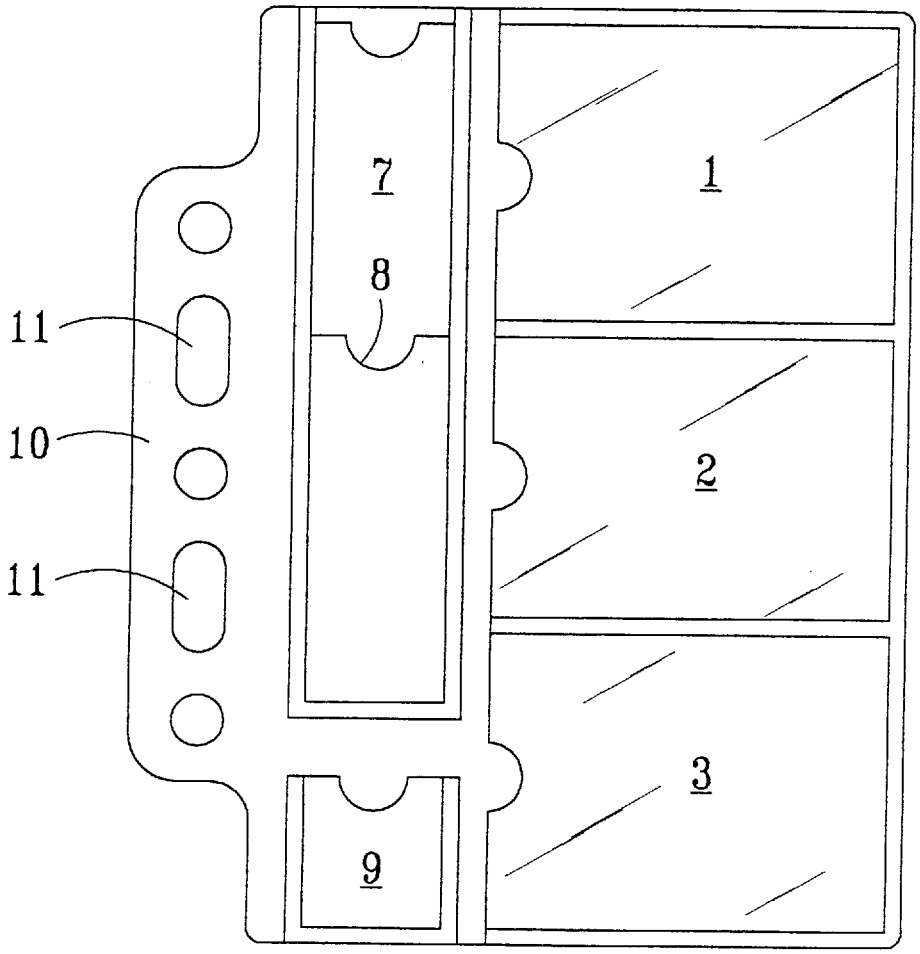
FIG. 1. is a front page view of the first example of loose-leaf page for both photographs and film storage FIG. 1A. is a back face view of the first example of loose-leaf page for both photographs and film storage FIG. 2. is a front page view of the second example of loose-leaf page for both photographs and film storage FIG. 2A. is a back face view of the second example of loose-leaf page for both photographs and film storage FIG. 3. is a front page view of the third example of loose-leaf page for both photographs and film storage FIG. 3A. is a back face view of the third example of loose-leaf page for both photographs and film storage FIG. 4. illustrates the five mounting variations which can be obtained with the inventive loose-leaf page Symbol Illustration.
Figure 1A:
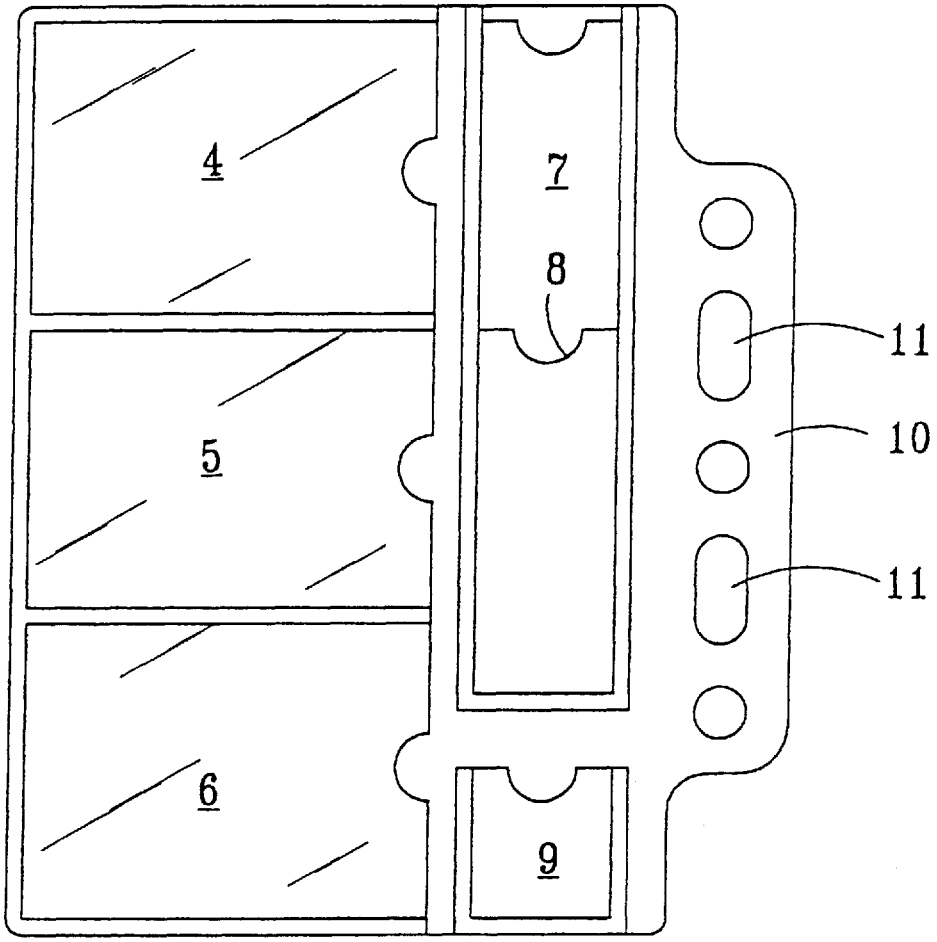

As shown in FIG. 1, the loose-leaf page has three pockets (1,2,3, conventional size 13×9.5 cm) on the front page and another three pockets (4,5,6, conventional size 13×9.5 cm) on its back face. There are a tatal of six photographs stored. On the left side of the long pocket (7, conventional size 23'3.5 cm) for storing a three, four, five, or a maximum of up to six consecutive film, and a short pocket (9, with size 3.5×4.3 cm) for holding a single film or two consecutive film.

In the center of the long pocket (7), an extra open edge (8) is designed for easy storage of a three, four, or five consecutive film set.

On the edge of the page, there are apertures for binding.

Figure 2:
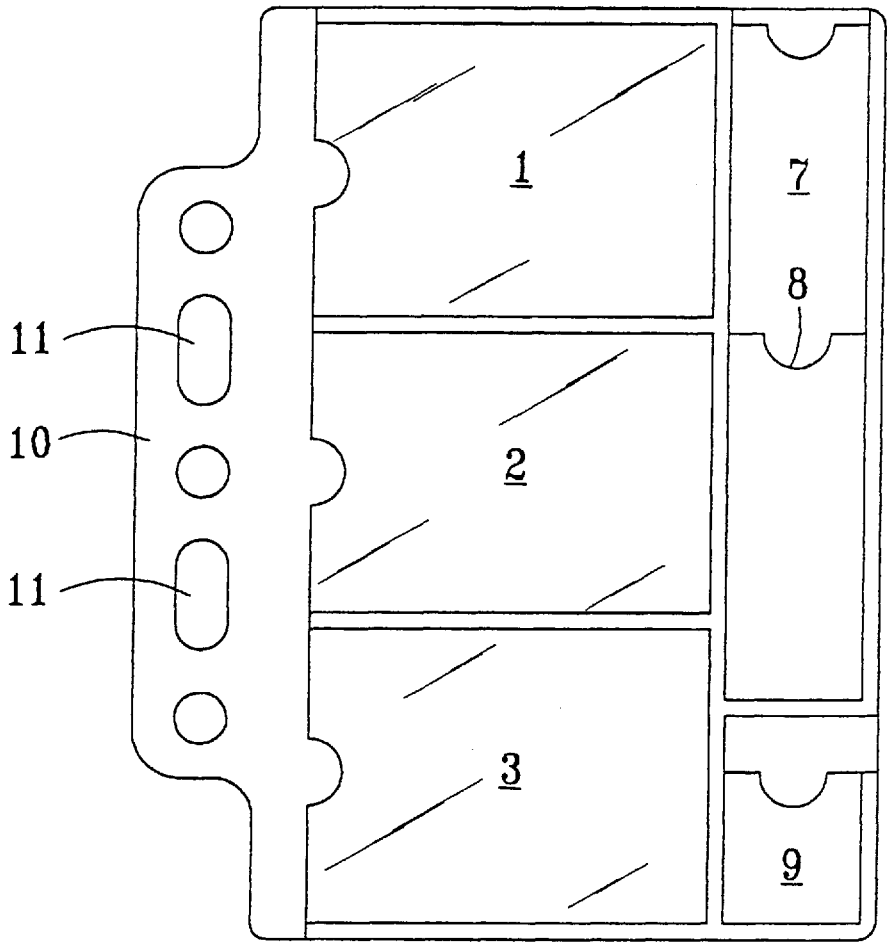
Figure 2A:
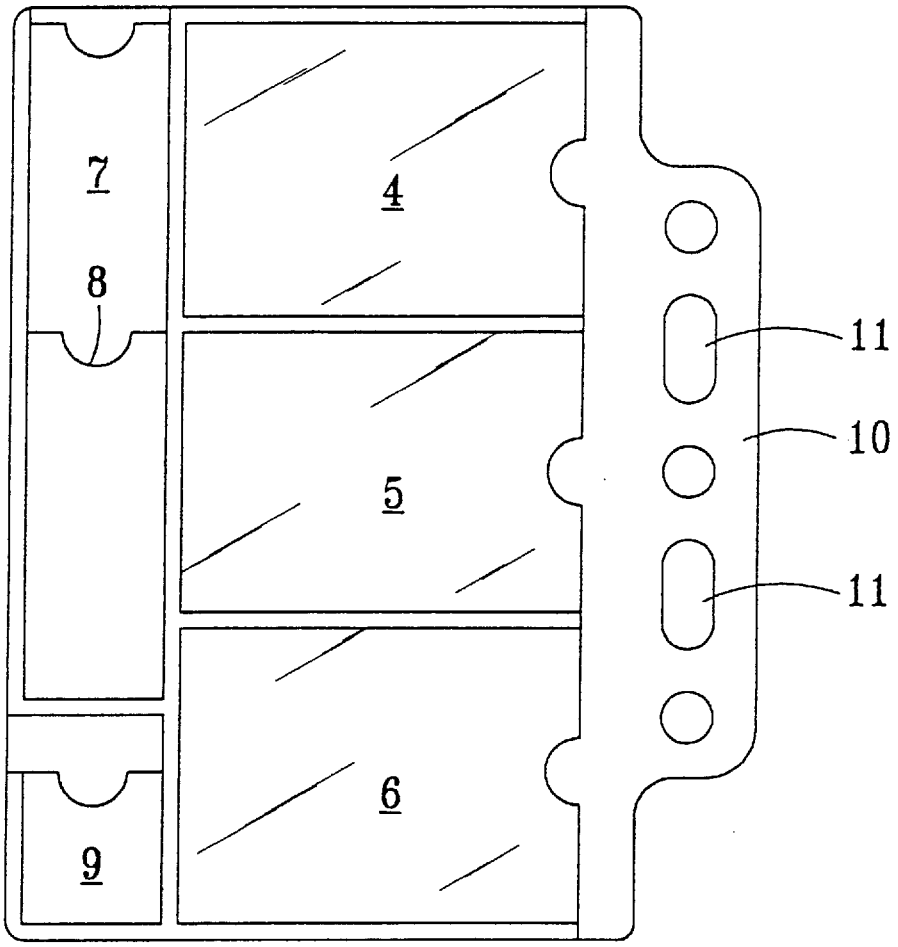

As shown in FIG. 2, the loose-leaf page has three pockets (1, 2,3) on the front page and another three pockets (4,5,6) on its back face, for storing a total of six photographs. On the right side of its front page, there are a long pocket (7) for storing a three, four, five, or a maximum of up to six consecutive film, and a short pocket (9) for holding a single film or two consecutive film.

In the center of the long pocket (7), an extra open edge(8) is designed for easy storage of a three, four, or five consecutive film set.

On the edge of the page, there are apertures for binding.

Figure 3:
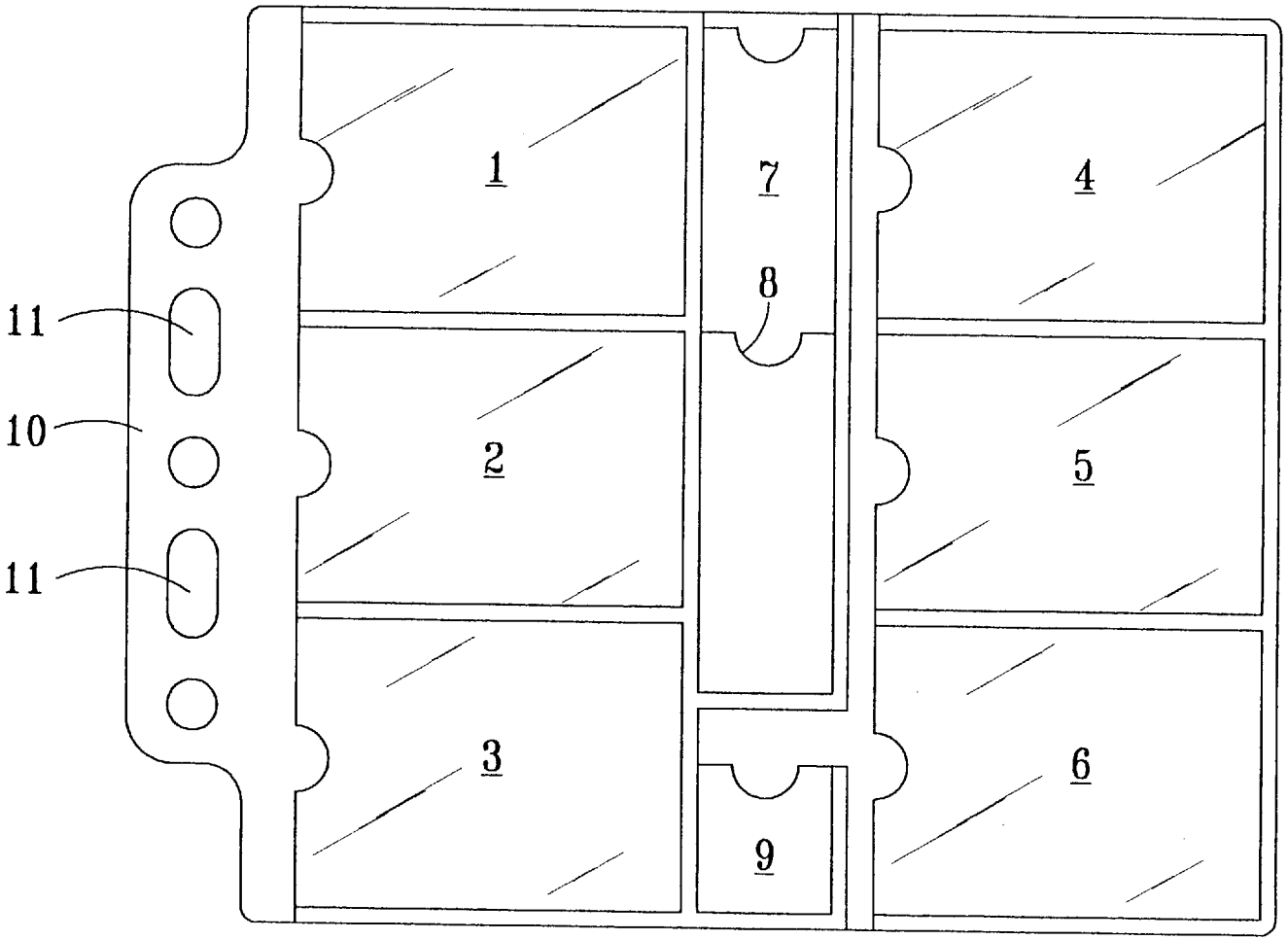
Figure 3A:
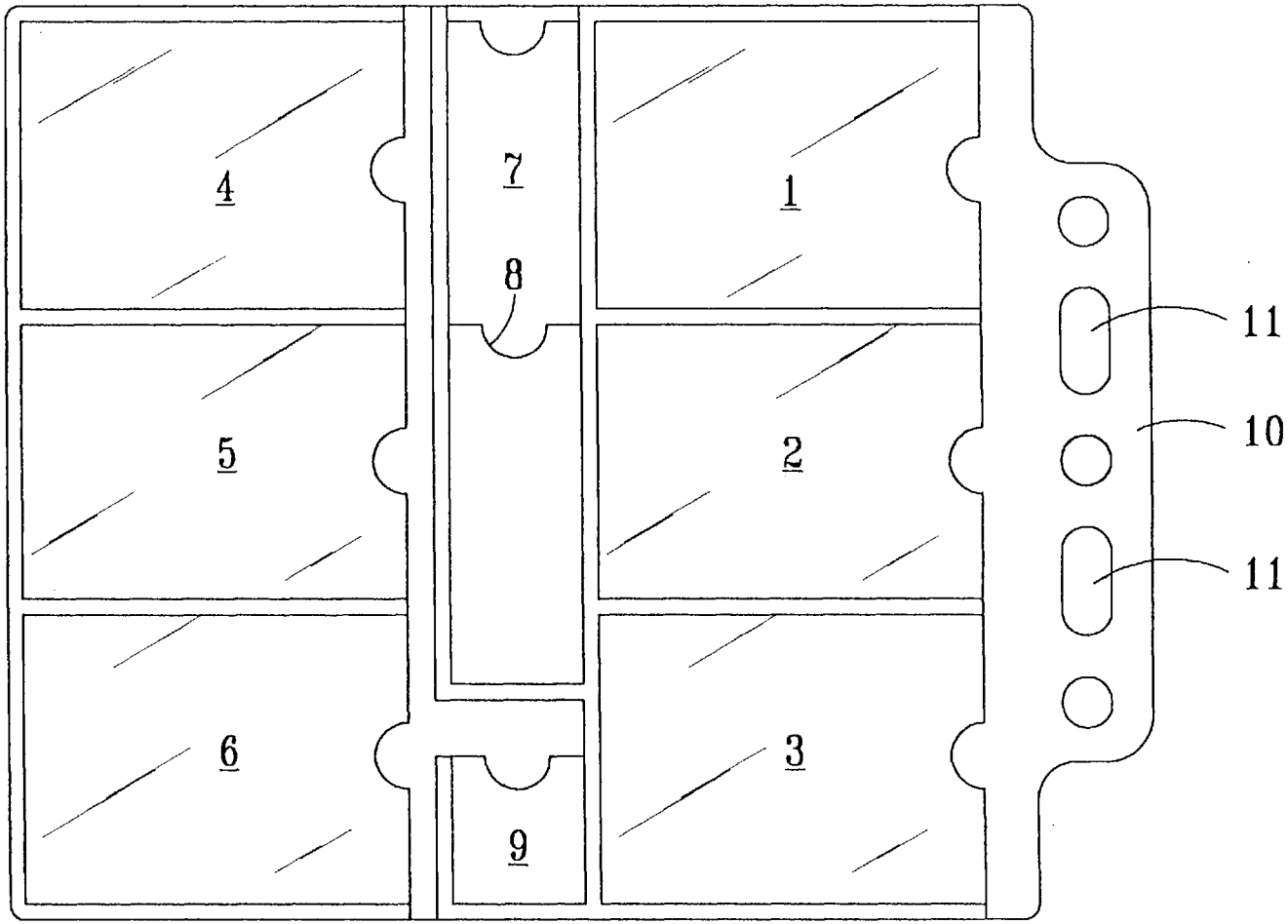
Figure 4A:
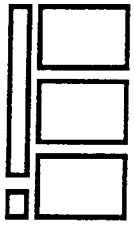
Figure 4B:
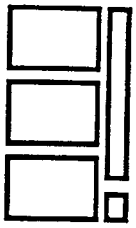
Figure 4C:
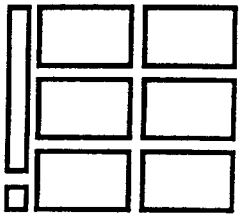
Figure 4D:
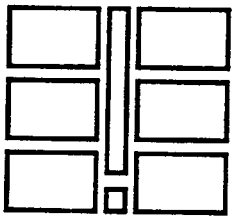
Figure 4E:
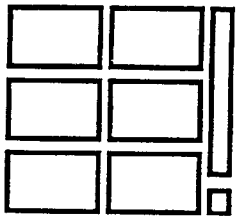
Figure 4F:
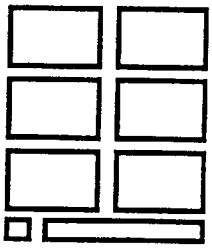
Figure 4G:
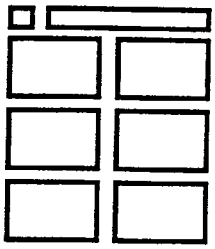

As shown in FIG. 3, the loose-leaf page has six pockets arranged in two columns and three rows for storing [6] six photographs (1,2,3,4,5,6) on one page. Between the two section of photographs, there are a long pocket (7) for storing a three, four, five, or a maximum of up to six consecutive film, and a short pocket (9) for holding a single film or two consecutive film.

In the center of the long pocket (7), an extra open edge (8) is designed for easy storage of a three, four, or five consecutive film set.

On the edge of the page, there are apertures for binding.

What is claimed is:

1. A loose-leaf page for both photographs and film storage comprising:

a first section of three pockets, each for single photograph storage, a second section of pocket with an open edge in the center for storing either three, four, five, or a maximum of up to six consecutive film set, and a third section of pocket for holding a single film.

2. The loose-leaf page as claimed in claim 1, wherein the second and third section of pockets can be placed on either the left or right side of the first sections of pockets.

3. A loose-leaf page for both photographs and film storage comprising:

a first section of pockets, arranged in two columns and three rows each which can store six photographs on each page, a second section of pocket with an open edge in the center for storing either a three, four, five, or maximum of up to six consecutive film set, and a third section of pocket for holding a single film or two consecutive film.

4. The loose-leaf page as claimed in claim 3, wherein the second and third section of pockets can be placed on the left, right, top, or bottom sides, or may be placed in the center of the first section of pockets.

* * * * *